US008174195B2

(12) United States Patent
Takagaki et al.

(10) Patent No.: US 8,174,195 B2
(45) Date of Patent: May 8, 2012

(54) MERCURY-FREE ARC TUBE FOR DISCHARGE LAMP UNIT

(75) Inventors: Michio Takagaki, Shizuoka (JP); Akira Homma, Shizuoka (JP); Takeshi Fukuyo, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 157 days.

(21) Appl. No.: 12/691,935

(22) Filed: Jan. 22, 2010

(65) Prior Publication Data

US 2010/0187995 A1 Jul. 29, 2010

(30) Foreign Application Priority Data

Jan. 29, 2009 (JP) ..... 2009-018628

(51) Int. Cl.
*H01J 61/22* (2006.01)
*H01J 61/20* (2006.01)

(52) U.S. Cl. ..... 313/638; 313/637; 313/631; 313/634; 313/641; 313/642

(58) Field of Classification Search ..... 313/637, 313/638
See application file for complete search history.

(56) References Cited

U.S. PATENT DOCUMENTS

| | | | | |
|---|---|---|---|---|
| 6,069,456 | A * | 5/2000 | Fromm et al. | 315/248 |
| 7,583,028 | B2 * | 9/2009 | Takagaki et al. | 313/637 |
| 2003/0048078 | A1 | 3/2003 | Fukuyo et al. | |
| 2005/0082987 | A1 * | 4/2005 | Uemura et al. | 313/637 |
| 2005/0146275 | A1 | 7/2005 | Fukuyo et al. | |
| 2006/0119264 | A1 | 6/2006 | Homma et al. | |
| 2007/0253203 | A1 | 11/2007 | Kubon et al. | |
| 2010/0045184 | A1 * | 2/2010 | Deguchi et al. | 313/631 |
| 2010/0066246 | A1 * | 3/2010 | Takagaki et al. | 313/623 |

FOREIGN PATENT DOCUMENTS

| | | | |
|---|---|---|---|
| EP | 2086001 | A1 | 8/2009 |
| EP | 2164093 | A2 | 3/2010 |
| JP | A-9-223481 | | 8/1997 |
| JP | A-2005-183165 | | 7/2005 |
| WO | 2008/056469 | A1 | 5/2008 |

OTHER PUBLICATIONS

Extended European Search Report issued Apr. 6, 2011 in corresponding European application No. 10151137.6.

* cited by examiner

*Primary Examiner* — Sikha Roy
(74) *Attorney, Agent, or Firm* — Sughrue Mion, PLLC

(57) ABSTRACT

A mercury-free arc tube for a discharge lamp unit including a closed glass bulb in which main light emitting substances of NaI, $ScI_3$, and $ScBr_3$ and buffer substances of InI and $ZnI_2$ are enclosed together with Xe gas, and wherein an amount of enclosed $ScBr_3$ is in a range of about 5 wt % to about 24 wt % relative to a total weight of the substances enclosed in the closed glass bulb. The mercury-free arc tube may also include a shroud glass tube, which is surrounds the closed glass bulb and a pair of electrodes, which are disposed to be opposed to each other in the closed glass bulb.

6 Claims, 5 Drawing Sheets

FIG. 2

| | PERCENTAGE OF ScBr3 (wt%) | LUMEN MAINTENANCE FACTOR (%) | | LIFETIME (HOURS) | INITIAL CHARACTERISTICS | |
|---|---|---|---|---|---|---|
| | | 1500 HOURS (%) | 2000 HOURS (%) | | LUMINOUS FLUX (lm) | TUBE VOLTAGE (V) |
| COMPARATIVE EXAMPLE (B.M) | 0.0 | 85.1 | 78.8 | 2320 | 2980 | 42.0 |
| EXPERIMENTAL EXAMPLE 1 | 5.0 | 85.5 | 79.7 | 2511 | 3120 | 42.5 |
| EXPERIMENTAL EXAMPLE 2 | 8.8 | 87.1 | 80.2 | 2711 | 3094 | 42.5 |
| EXPERIMENTAL EXAMPLE 3 | 15.0 | 87.2 | 82.1 | 2675 | 3060 | 42.1 |
| EXPERIMENTAL EXAMPLE 4 | 20.0 | 88.4 | 81.7 | 2788 | 3070 | 42.2 |
| EXPERIMENTAL EXAMPLE 5 | 23.8 | 86.8 | 79.4 | 2666 | 3011 | 41.3 |
| EXPERIMENTAL EXAMPLE 6 | 28.8 | 84.5 | 78.5 | 2305 | 2971 | 40.6 |

MERCURY-FREE ARC TUBE FOR DISCHARGE LAMP UNIT

This application claims priority from Japanese Patent Application No. 2009-018 628, filed on Jan. 29, 2009, the entire contents of which are herein incorporated by reference.

BACKGROUND

1. Technical Field

The present disclosure relates to an arc tube for a discharge lamp unit, and particularly, to a mercury-free arc tube for the discharge lamp unit, which does not contain mercury, used as a light source of a vehicle headlamp.

2. Related Art

In recent years, discharge lamp units have been employed in vehicle headlamps because of advantages of light emitting efficiency and favorable color rendering properties as well as a longer lifetime compared to that of a filament type lamp unit. The discharge lamp unit is configured such that a metal halide arc tube, which is a light source, is supported by a pair of metallic lead supports projected from insulating bases.

In the arc tube, both ends of openings of the quartz glass tube are pinch-sealed, and a closed glass bulb is formed as a discharge portion in the center thereof in a longitudinal direction. At each pinch seal portion, an electrode assembly, which includes a tungsten electrode rod, a Molybdenum foil, and a Molybdenum lead wire integrated in series, is sealed. The front ends of the electrode rods are projected into the closed glass bulb to constitute a pair of electrodes.

The lead wire is led out from the pinch seal portion and is welded to a lead support. The lead support supports the arc tube, and is formed as a current conduction path to the lead wire.

JP-A-9-223481 discloses an arc tube for a discharge lamp unit having a closed glass bulb serving as a discharge portion in which Mercury, NaI, $ScI_3$ and $ScBr_3$ are enclosed together with Xe gas and the amount of enclosed $ScBr_3$ is adjusted to be within the range of about 20 wt % to about 80 wt % relative to the total amount of enclosed $ScI_3$ and $ScBr_3$ (a portion of $ScI_3$ is replaced with $ScBr_3$, which has a larger binding energy (i.e. it is harder for disassociation to occur) than $ScI_3$). With such a configuration, the arc tube for the discharge lamp unit is capable of suppressing a reaction between $ScI_3$ and glass (i.e. devitrification phenomenon whereby glass is eroded) and erosion of the electrodes, thus becoming free from flicker and deterioration in the lumen maintenance factor over a long period of time.

Here, deterioration in lumen maintenance factor is caused by a decrease in light emission of metal iodide enclosed in the closed glass bulb, in particular, scandium iodide ($ScI_3$). The decrease in light emission of scandium iodide is caused because a chemical reaction between scandium iodide and quartz glass ($SiO_2$) occurs and results in loss of scandium iodide. The loss of scandium iodide is caused by the reaction between scandium iodide and quartz glass expressed by chemical formula (1) shown below. As a result, scandium iodide is changed into oxide, and this causes a decrease in Sc vapor pressure, thereby decreasing luminous flux.

$$4ScI_3+3SiO_2 \rightarrow 2Sc_2O_3+3SiI_4 \quad (1)$$

Further, when the reaction represented by the above formula occurs, not only the loss of scandium iodide occurs, but also erosion (devitrification) of quartz glass occurs. Furthermore, $SiI_4$ created by the above reaction reacts with the tungsten of the electrode rods as expressed by formula (2) below, and this reaction creates SiWn, which has a low melting point.

Thus, the electrodes are melted, and the distance between the electrodes increases, thereby rising tube voltage. Further, since iodine ($I_2$) having a high vapor pressure is created and the tube voltage increases, lighting becomes unstable or, worse lighting becomes impossible.

$$SiI_4+Wn \rightarrow SiWn+2I_2 \quad (2)$$

As described above, the main factor in the devitrification is that the inner wall of the quartz glass tube is eroded by the reaction expressed by formula (1) above. At this point, in order to eliminate devitrification, it is necessary to decrease an amount of the reaction between quartz glass and $ScI_3$. Accordingly, bromine (Br), which has a stronger binding energy with Sc than iodine (I), has attracted attention. That is, since a part of $ScI_3$ is replaced with $ScBr_3$, which has a larger binding energy (i.e. it is harder for disassociation to occur) than $ScI_3$, the amount of the reaction between $ScI_3$ and the quartz glass ($SiO_2$) is small, and the progress of the reactions of formulas (1) and (2) above is reduced. From this viewpoint, JP-A-9-223481 was proposed.

On the other hand, JP-A-2005-183165 (see e.g., the fifth and sixth examples), discloses a mercury-free arc tube for a discharge lamp unit in which mercury, which is toxic to the environment, is not enclosed in the closed glass bulb of the arc tube. In the closed glass bulb of the arc tube, not only NaI and $ScI_3$ but also InI and $ZnI_2$ serving as buffer substances substituted for mercury are enclosed together with Xe gas. By adjusting the pressure of sealed Xe gas and the amount of $ScI_3$ enclosed, the mercury-free arc tube has substantially the same initial characteristics (a tube voltage, luminous flux, and initial rise of luminous flux) as the arc tube which contains mercury.

The mercury-free arc tube disclosed in JP-A-2005-183165 has substantially the same initial characteristics as the arc tube which contains mercury. However, the mercury-free arc tube is used under high load conditions such that the pressure of sealed Xe gas is higher and the set tube voltage is lower (current flowing through the electrodes is larger) than that of the arc tube which contains mercury. Hence, the deterioration in lumen maintenance factor, which is caused by the reaction between $ScI_3$ and glass (devitrification phenomenon whereby glass is eroded) or the occurrence of flicker due to erosion of the electrodes, is notable as compared with the arc tube which contains mercury, and thus the lifetime is shortened to that extent.

For this reason, it has been considered that the mercury-free arc tube should sustain lumen maintenance factor and should have a long lifetime by suppressing the reaction between $ScI_3$ and glass (devitrification phenomenon whereby glass is eroded) or the occurrence of flicker due to erosion of the electrodes.

However, FIG. 4 of JP-A-9-223481 shows a change in tube voltage of the arc tube which contains mercury in a case where a percentage of the amount of enclosed $ScBr_3$ is increased. As can be seen from the drawing, during a period up until 2,000 hours have elapsed from the first lighting (0 hours), tube voltages of examples (examples A to D) containing $ScBr_3$ in a range of 5 to 15% are lower by about 10 V than tube voltages of comparative examples 1 and 2 containing $ScBr_3$ at 0% (a case where $ScBr_3$ is not enclosed at all). This is due to the fact that the vapor pressure of $ScBr_3$ is lower than that of $ScI_3$.

In addition, since the arc tube containing mercury is capable of compensating for the deterioration in tube voltage by adjusting the amount of enclosed mercury, the increase in the percentage of $ScBr_3$ to $ScI_3$ is effective for suppressing devitrification and erosion of the electrodes. Meanwhile, in the mercury-free arc tube, which does not contain mercury, the InI and $ZnI_2$ serve as buffer substances in substitution for mercury, but it is not easy to compensate for the significant deterioration in tube voltage corresponding to 10 V. Accordingly, it has been considered that though it is effective to increase "the percentage of $ScBr_3$ to $ScI_3$" for the arc tube containing mercury, this strategy is not applicable to the mercury-free arc tube.

However, for the mercury-free arc tube, the inventors of the present application have conducted an experiment in which the amount of enclosed $ScBr_3$ is increased relative to the total weight of the enclosed substances within the closed glass bulb. As a result, as shown in FIGS. 6 and 7, an unexpected result was obtained in which the luminous flux and the tube voltage at the initial stage of lighting can be increased by slightly increasing the amount (percentage) of enclosed $ScBr_3$.

The reason may be that the vapor pressure within the closed glass bulb is increased by the synergy effect caused by mixing $ScI_3$ with $ScBr_3$. In the case of metal halide arc tube, a NaI—$ScI_3$ based metal produces a complex halide of $NaI.ScI_3$, and thus the vapor pressure within closed glass bulb noticeably increases. Then, by adding $ScBr_3$ thereto, a complex halide of $NaI.ScI_3.ScBr_3$ is produced, and it can be expected that the vapor pressure further increases.

That is, it was confirmed that when the amount of $ScBr_3$ enclosed in the closed glass bulb of the mercury-free arc tube is adjusted to be within a given range relative to the total weight of the enclosed substances, it is possible to suppress the reaction between $ScI_3$ and glass (devitrification phenomenon whereby glass is eroded) and thus obtain a desirable lumen maintenance factor and lifetime.

SUMMARY

Exemplary embodiments of the present invention address the above disadvantages and other disadvantages not described above. However, the present invention is not required to overcome the disadvantages described above, and thus, an exemplary embodiment of the present invention may not overcome any disadvantages described above.

Accordingly, it is an illustrative aspect to provide a mercury-free arc tube for a discharge lamp unit having a lumen maintenance factor and a lifetime improved by suppressing devitrification at the tube wall of the closed glass bulb.

According to one or more illustrative aspects of the present invention, there is provided a mercury-free arc tube for a discharge lamp unit including: a shroud glass tube; a closed glass bulb, which is surrounded by the shroud glass tube; and a pair of electrodes, which are disposed to be opposed to each other in the closed glass bulb, wherein main light emitting substances of NaI, $ScI_3$, and $ScBr_3$ and buffer substances of InI and $ZnI_2$ are enclosed together with Xe gas in the closed glass bulb, and wherein an amount of enclosed $ScBr_3$ is in a range of about 5 wt % to about 24 wt % relative to a total weight of the substances enclosed in the closed glass bulb.

Other aspects and advantages of the present invention will be apparent from the following description, the drawings and the claims.

BRIEF DESCRIPTION OF THE DRAWINGS

FIG. 2 is a diagram showing lighting test results (life performance characteristics and initial characteristics) of Experimental Examples 1 to 6 and a Comparative Example;

DETAILED DESCRIPTION OF EXEMPLARY EMBODIMENTS

Exemplary embodiments of the present invention will be described in detail with reference to the drawings.

Figure 1:
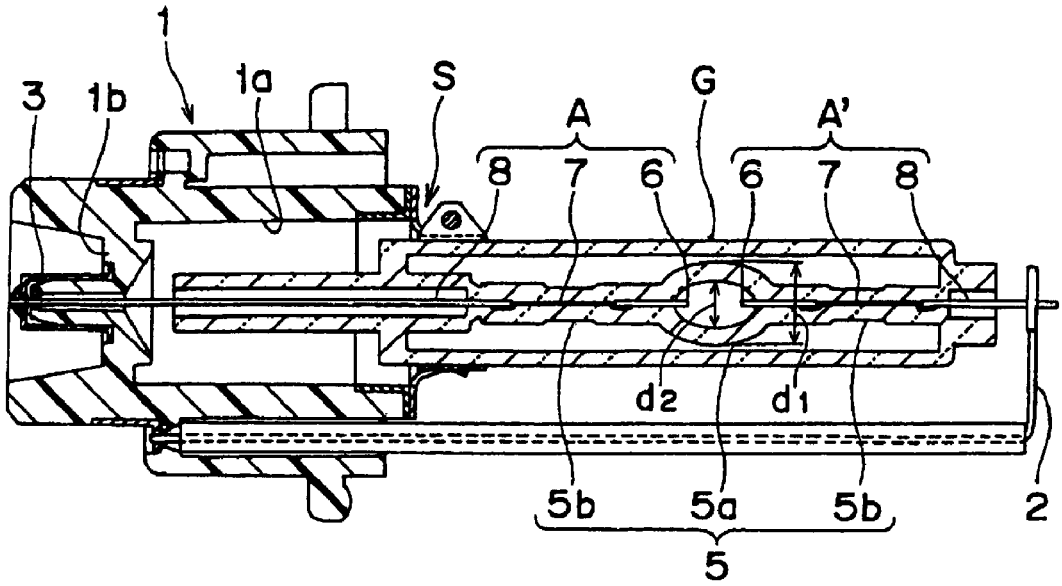
FIG. 1 is a vertical sectional view of an example of a discharge lamp unit according to an exemplary embodiment of the present invention.

In FIG. 1, the discharge lamp unit is integrated with an arc tube 5 projected toward the front side of an insulating base 1. Specifically, the front end portion of the arc tube 5 is supported by a lead support 2 projected toward the front side of the insulating base 1. The rear end portion of the arc tube 5 is supported by welding a lead wire 8, which is led out from the arc tube 5, to a metallic cap 3 attached to the rear end portion of the insulating base 1. In addition, the rear end portion side of the arc tube 5 is held by a metallic support member S fixed on the front side of the insulating base 1. Reference Numeral 1*a* designates a concave portion, which is opened toward the front side of the insulating base 1, for housing the rear end portion of the arc tube 5.

The arc tube 5 has a very compact configuration in which a spherical bulged portion is formed in the middle of the linear portion of a circular pipe-shaped quartz glass tube extended in a longitudinal direction, the spherical bulged portion side of the cylindrical quartz glass tube is pinch-sealed, and pinch seal portions 5*b* and 5*b*, which have rectangular shapes in a horizontal section, are formed on both end portions of the spheroid closed glass bulb 5*a* which has no tip and is formed as a discharge space.

In the closed glass bulb 5*a* serving as a closed chamber, electrodes 6 and 6 are disposed to be opposed to each other, and given amounts of the main light emitting metal halide (NaI, $ScI_3$, $ScBr_3$) and the buffer metal halide (InI, $ZnI_2$) are enclosed together with the starting rare gas (Xe gas), but the mercury (Hg) is not enclosed at all.

Each of the electrodes 6 and 6 is connected to a Molybdenum foil 7 sealed at the pinch seal portion 5*b*, and Molybdenum lead wires 8 and 8 connected to the Molybdenum foils 7 and 7 are led out from the end portions of the pinch seal portions 5*b* and 5*b*. Specifically, in each of electrode assemblies A and A', the electrode (constituted by the electrode rod) 6, the Molybdenum foil 7, and the lead wire 8 are connected in series to be integrated, and an area including at least the Molybdenum foil 7 is sealed at the pinch seal portion 5*b*. With such a configuration, the pair of electrodes (electrode rods) 6 are disposed in the closed glass bulb 5*a* so as to be opposed to each other. The electrode (the electrode rod) 6 is set as follows: the front end side is thick and has a diameter of about 0.35 mm; the shaft portion side of the base end is thin and has a diameter of about 0.30 mm; it is constituted by a stepwise electrode rod made of thorium tungsten; the length thereof projected into the closed glass bulb 5*a* is about 1.8 mm; and the distance between the electrodes is a mechanical gap of about 3.8 mm (an optical gap of about 4.2 mm).

Reference sign G designates an ultraviolet-shielding shroud glass tube, which has a cylindrical shape, for cutting off ultraviolet rays having a wavelength range harmful to the human body from rays emitted from the closed glass bulb 5*a*. The shroud glass tube G is welded to a cylindrical non-pinch seal portion integrated at the both ends of the arc tube 5. In the shroud tube G (a space surrounding the closed glass bulb 5*a*), nitrogen gas ($N_2$) of about 0.1 atmospheres is enclosed for heat insulation against heat radiation from the closed glass bulb 5*a*, and this configuration keeps the closed glass bulb 5*a* at a high temperature.

Further, as shown in FIG. 1, a maximum external diameter (an inner diameter) d1 (d2) of the closed glass bulb 5*a* is about 6.1 mm (2.5 mm), and an inner volume thereof is about 22 μl. In the closed glass bulb 5*a*, as described above, the given amount of the metal halide (NaI, $ScI_3$, $ScBr_3$, InI, $ZnI_2$) is enclosed together with the Xe gas (a sealing pressure of 15 atmospheres).

Specifically, in the closed glass bulb 5*a*, the metal halide (NaI, $ScI_3$, $ScBr_3$, InI, $ZnI_2$) having a total weight of about 0.3 mg is enclosed, and an amount of enclosed $ScBr_3$ is adjusted to be within the range of about 5 wt % to about 24 wt % relative to the total weight (0.3 mg) of the enclosed metal halide. As a result, deformation of the electrodes and occurrence of flicker is suppressed, and a decrease in vapor pressure within the closed glass bulb 5*a* is also suppressed. In addition, the lumen maintenance factor is sustained for a long period of time, and a long lifetime is also secured.

That is, since a binding energy of $ScBr_3$ is larger than that of $ScI_3$ (i.e. it is harder to cause dissociation), $ScBr_3$ is scarcely dissociated in the vicinity of the tube wall of the closed glass bulb 5*a* having a low temperature. Thus, the progress of the reaction of chemical formula (1) above is suppressed. In other words, since a part of $ScI_3$ is replaced with $ScBr_3$, which makes it harder to cause reaction with the quartz glass, the reaction between $ScI_3$ and the quartz glass is relaxed, and devitrification of the tube wall is suppressed. Further, as the reaction of chemical formula (1) is reduced, the reaction of chemical formula (2) is also reduced. As a result, deformation of the electrodes and occurrence of flicker is suppressed, the lumen maintenance factor is sustained for a long period of time, and lifetime is extended.

Further, when $ScBr_3$ having a vapor pressure lower than $ScI_3$ is enclosed in the closed glass bulb 5*a*, it can be expected that the vapor pressure within the closed glass bulb 5*a* is significantly lowered. However, due to the synergy effect caused by mixing $ScI_3$ and $ScBr_3$, the vapor pressure within the glass bulb 5*a* rather increases, and the tube voltage rises. That is, in such a type of arc tube, a NaI—$ScI_3$ based metal produces a complex halide of NaI.$ScI_3$, and thus the vapor pressure noticeably increases. Then, by adding $ScBr_3$ thereto, a complex halide of NaI.$ScI_3$.$ScBr_3$ is produced, and it can be expected that the vapor pressure further increases. As a result, a desirable tube voltage and a desirable luminous flux value are obtained at the initial stage of lighting.

Here, when the amount of enclosed $ScBr_3$ is less than 5 wt % of the total weight of the enclosed substances, the effect (i.e. the effect of suppressing the reaction between $ScI_3$ and glass) caused by enclosing $ScBr_3$ is not sufficiently exhibited. Further, when the amount is larger than 24 wt % of the total weight of the enclosed substances, there is too much Br representing strong chemical activity. For this reason, not only does a problem arises in that the electrodes are corroded and scattered, but it is also difficult to obtain desirable initial characteristics. As a result, it is advantageous that the amount of enclosed $ScBr_3$ be within the range of about 5 wt % to about 24 wt % relative to the total weight of the enclosed substances within the closed glass bulb.

Figure 3:
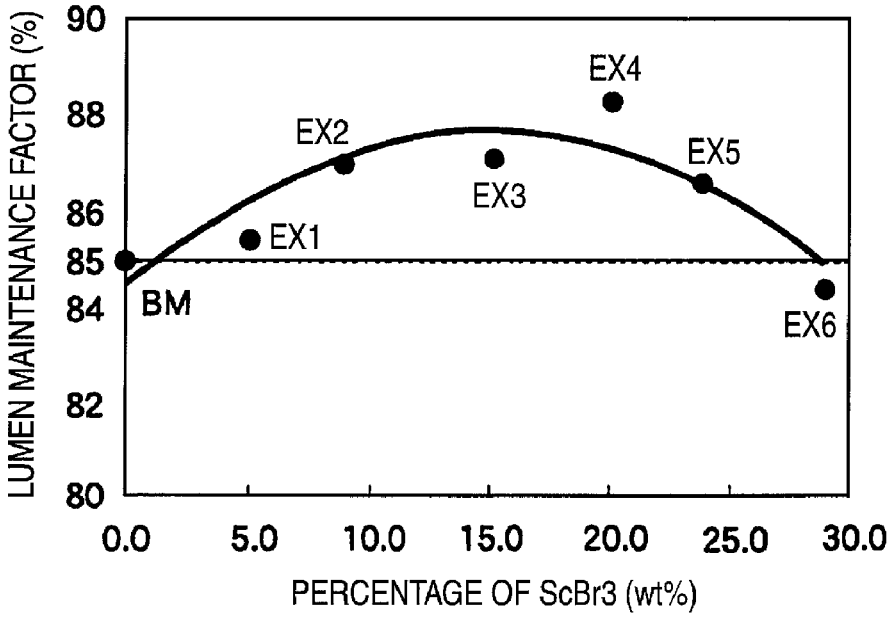
FIG. 3 is a diagram showing the life performance characteristics of Experimental Examples 1 to 6 and a Comparative Example, and showing a relationship between the amount of enclosed $ScBr_3$ and the lumen maintenance factor (the lumen maintenance factor at 1,500 hours)
Figure 4:
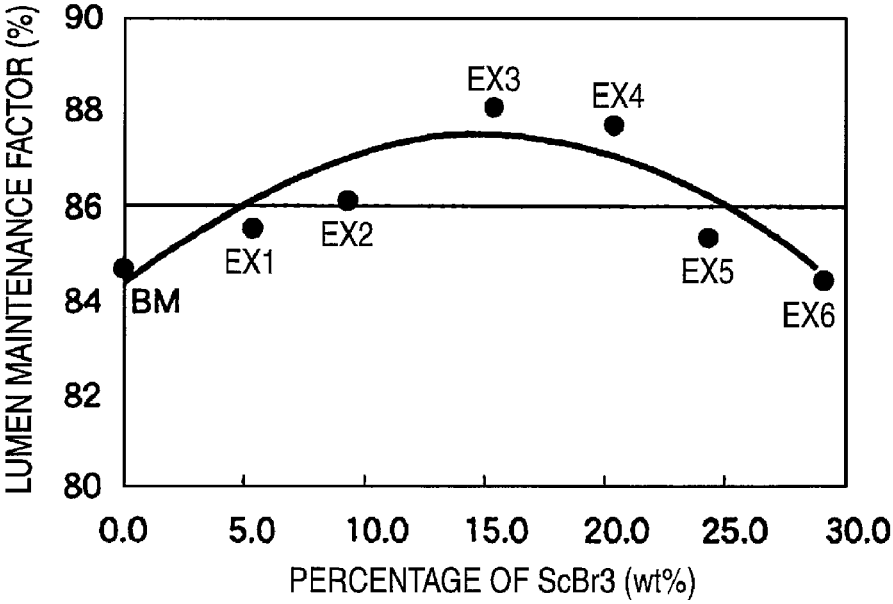
FIG. 4 is a diagram showing the life performance characteristics of Experimental Examples 1 to 6 and Comparative Example, and showing a relationship between the amount of enclosed $ScBr_3$ and the lumen maintenance factor (the lumen maintenance factor at 2,000 hours)
Figure 5:
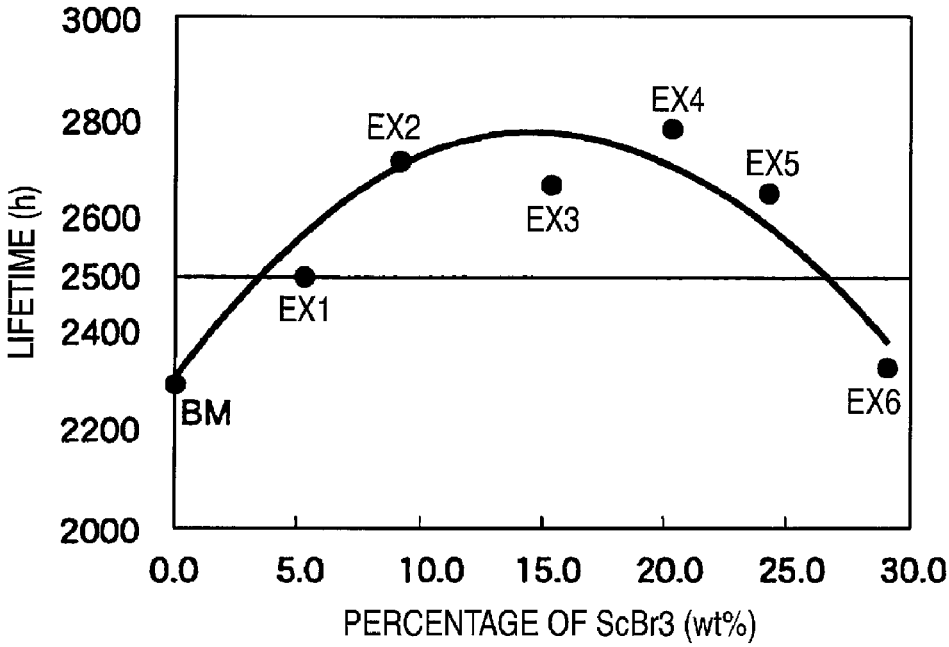
FIG. 5 is a diagram showing the life performance characteristics (lifetimes) of Experimental Examples 1 to 6 and Comparative Example, and showing a relationship between the amount of enclosed $ScBr_3$ and the lifetime.

Specifically, such a type of mercury-free arc tube is in need of, for example, initial characteristics such that a luminous flux value at the initial stage of lighting is 3,000 lumens or more, and life performance characteristics that a lumen maintenance factor (1,500 hours) is 85% or more, a lumen maintenance factor (2,000 hours) is 79% (about 80%) or more, and a lifetime is 2,500 hours or more. However, when the amount of enclosed $ScBr_3$ is within the range of about 5 wt % to about 24 wt % relative to the total weight of the enclosed substances within the closed glass bulb, the following characteristics are secured: the luminous flux value at the initial stage of lighting is 3,000 lumens or more (see FIGS. 2 and 6); the lumen maintenance factor (1,500 hours) is 85% or more (see FIGS. 2 and 3); the lumen maintenance factor (2,000 hours) is 79% (about 80%) or more (see FIGS. 2 and 4); and the lifetime is 2,500 hours or more (see FIGS. 2 and 5). Further, the tube voltage of 41 V or more (see FIGS. 2 and 7), which is slightly lower than 42 V in the case where $ScBr_3$ is not enclosed at all, at the initial stage of lighting is secured.

Consequently, as can be seen from FIGS. 2 to 5 showing the life performance characteristics, when the amount of enclosed $ScBr_3$ is within the range of about 5 wt % to about 24 wt % relative to the total weight of the enclosed substances within the closed glass bulb, the lumen maintenance factor at 1,500 hours is 85% or more, the lumen maintenance factor at 2,000 hours is 79% (about 80%) or more, and the lifetime is 2,500 hours or more.

Figure 6:
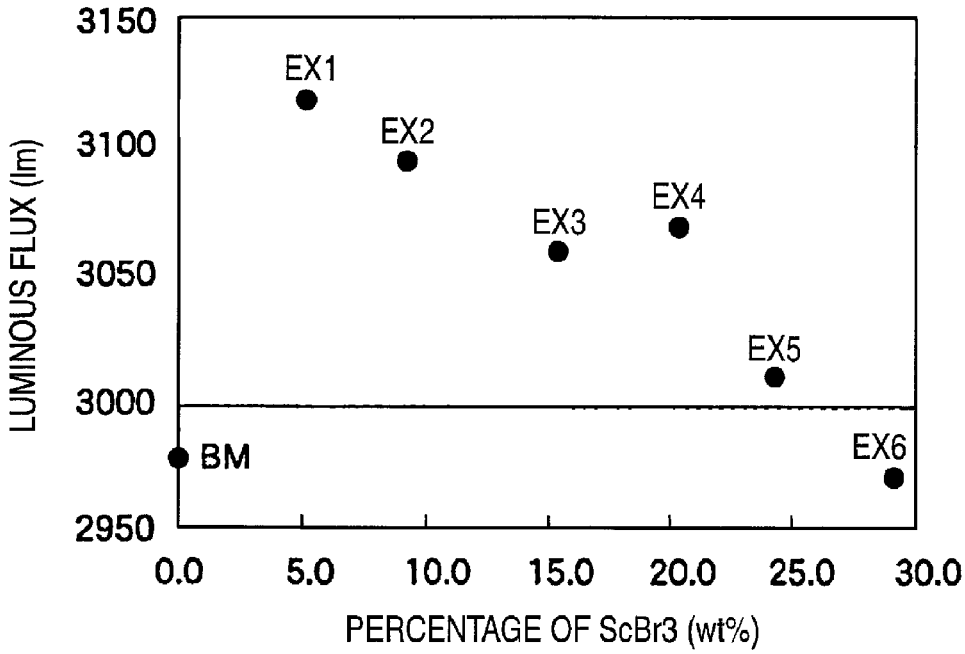
FIG. 6 is a diagram showing initial characteristics of Experimental Examples 1 to 6 and Comparative Example, and showing a relationship between the amount of enclosed $ScBr_3$ and the luminous flux.
Figure 7:
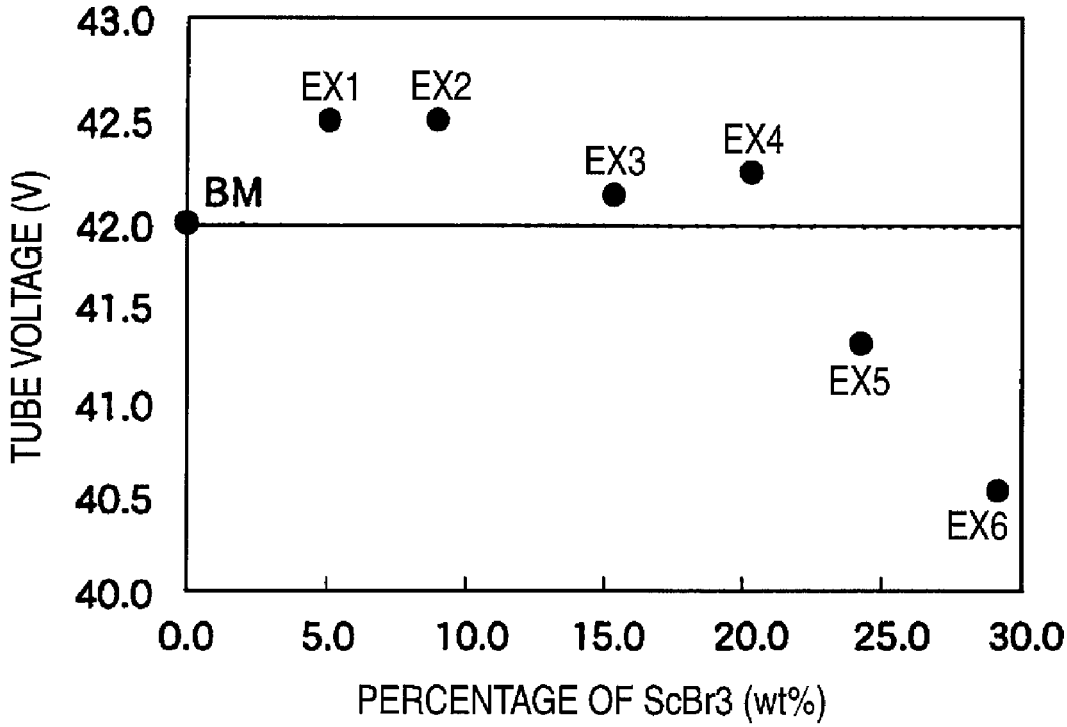
FIG. 7 is a diagram showing initial characteristics of Experimental Examples 1 to 6 and Comparative Example, and showing a relationship between the amount of enclosed $ScBr_3$ and the tube voltage.

Further, as can be seen from FIGS. 2, 6, and 7 showing the initial characteristics, when the amount of enclosed $ScBr_3$ is within the range of about 5 wt % to about 24 wt % relative to the total weight of the enclosed substances within the closed glass bulb, the luminous flux value at the initial stage of lighting is 3,000 lumens or more, the tube voltage at the initial stage of lighting is 41 V or more. In addition, when the amount of enclosed $ScBr_3$ is within the range of about 5 wt % to about 20 wt % relative to the total weight of the enclosed substances within the closed glass bulb, the tube voltage at the initial stage of lighting is 42 V or more.

Accordingly, in order to secure the tube voltage of 41 V or more at the initial stage of lighting, the amount of enclosed $ScBr_3$ may be within the range of about 5 wt % to about 24 wt % relative to the total weight of the enclosed substances within the closed glass bulb. However, in order to secure the tube voltage of 42 V or more at the initial stage of lighting, it is advantageous that the amount of enclosed $ScBr_3$ should be within the range of about 5 wt % to about 20 wt % relative to the total weight of the enclosed substances within the closed glass bulb.

Further, the electrode assemblies A and A' are subjected to a vacuum heat treatment at a temperature of about 200° C. to about 800° C. before being sealed at the pinch seal portions 5*b* and 5*b*. Thus, the electrode assemblies A and A' are sealed at and formed integrally with the pinch seal portions 5*b* and 5*b* in a state where impurities, such as water and an oxide film attached to the electrode assemblies A and A', have been removed.

When the impurities such as water and oxide film are attached to the electrode assemblies A and A', the reactions of formulas (1) and (2) progress, thereby promoting the occurrence of flicker. However, by using the pinch-sealed electrode assemblies A and A' from which the impurities, such as water and an oxide film attached thereto have been removed by previously performing the vacuum heat treatment thereon, the reactions of chemical formulas (1) and (2) are relaxed and the occurrence of flicker is suppressed in the closed glass bulb 5*a*.

Further, in a pinch seal process of pinch-sealing the electrode assemblies A and A', water ($H_2O$) and oxygen ($O_2$) are removed by sufficiently heating the inside of the glass tube W, and pinch sealing is performed while inert gas is supplied. Then it is advantageous to prevent water ($H_2O$) and oxygen ($O_2$) from entering into the closed glass bulb 5*a* and the shroud glass tube G (the space surrounding the closed glass bulb 5*a*) as much as possible by sealing the shroud glass tube G while enclosing the inert gas in the shroud glass tube G (the space surrounding the closed glass bulb 5*a*) using a shroud glass tube sealing process of sealing the area of the arc tube including the closed glass bulb 5*a* with the shroud glass tube G.

Furthermore, the electrode rod 6, the Molybdenum foil 7, and the lead wire 8 constituting the electrode assemblies A and A' may be subjected to the respective treatments of removing the impurities (the water and the oxide film) at the respective steps of forming these components. However, even after the electrode rod 6, the Molybdenum foil 7, and the lead wire 8 are bonded and integrated as the electrode assemblies A and A', the electrode assemblies A and A' are subjected to the treatment of removing the impurities (the water and the oxide film). In such a manner, the impurities (the water and the oxide film) attached to the electrode assemblies A and A' are reliably removed, and subsequently the pinch seal process is performed.

Specifically, the electrode rod 6, the Molybdenum foil 7, and the lead wire 8 constituting the electrode assemblies A and A' may be subjected to the respective treatments of removing the impurities (the water and the oxide film) at the respective steps of the components. For example, the electrode rod 6 is subjected to the vacuum heat treatment using a vacuum heat furnace at about 1600° C. to about 2200° C., the Molybdenum foil 7 is subjected to an oxidization treatment (at about 300° C. to about 500° C.) and a deoxidization treatment (at about 900° C.) using an oxidization-deoxidization furnace after a Molybdenum foil material (the Molybdenum foil material formed in a band shape having a given width is wound in a spool shape) wound in a spool shape is unwound. Further, after the electrode rod 6, the Molybdenum foil 7, and the lead wire 8 are bonded and integrated as the electrode assemblies A and A', the electrode assemblies A and A' are subjected to vacuum heat treatment at about 200° C. to about 800° C. through the vacuum heat furnace and, thus electrode assemblies A and A', from which the impurities (the water and the oxide film) have been reliably removed, are obtained. Furthermore, in order to more reliably remove the impurities (the water and the oxide film), it is advantageous to perform the vacuum treatment while washing the electrode assemblies A and A' with inert gas whose moisture density is adjusted to be 1 ppm or less.

Further, in the pinch seal process, in order not to oxidize the electrode assemblies A and A', it is advantageous to pinch-seal the electrode assemblies A and A' while supplying the inert gas (argon gas or nitrogen gas) to the inside of the glass tube W.

Further, it is advantageous to prevent water ($H_2O$) and oxygen ($O_2$) from entering into the closed glass bulb 5*a* and the shroud glass tube G (the space surrounding the closed glass bulb 5*a*) as much as possible by sealing the shroud glass tube G while supplying the inert gas (argon gas or nitrogen gas) in the shroud glass tube G (the space surrounding the closed glass bulb) using a shroud glass tube sealing process of sealing the area of the arc tube including the closed glass bulb 5*a* with the shroud glass tube G.

Next, results of tests of the initial characteristics and the life performance characteristics conducted on the arc tubes according to Experimental Examples 1 to 6, each of which contains a different amount of enclosed metal halide within the closed glass bulb 5*a*, will be described with reference to FIGS. 2 to 7.

By using the discharge lamp unit shown in FIG. 1, the arc tubes of Experimental Examples 1 to 6 and Comparative Example are subjected to tests in a flickering mode wherein a light is turned on and off at a given time interval with a lighting power of about 35W. Thereby, the luminous flux values at the initial stage of lighting and tube voltage and the lumen maintenance factors (assuming that the luminous flux at the time of starting the test is 100%, a percentage of the respective luminous flux values at the elapse of 1,500 hours and 2,000 hours) at the elapse of 1,500 hours and 2,000 hours are obtained.

EXPERIMENTAL EXAMPLE 1

In Experimental Example 1, the amounts of enclosed metal halides within the closed glass bulb 5*a* are adjusted to be about $NaI:ScI_3:ScBr_3:InI:ZnI_2$=62:23.8:5:0.2:9 wt %. That is, the amount of enclosed $ScBr_3$ relative to the total amount of enclosed metal halides is about 5 wt %.

The luminous flux and the tube voltage at the initial stage of lighting are about 3,120 lumens and about 42.5 V, and thus satisfy the target values of about 3,000 lumens and about 42 V, respectively. In the life performance characteristics, the lumen maintenance factor at 1,500 hours is about 85.5%, the lumen maintenance factor at 2,000 hours is 79.7% (about 80%), the lifetime is about 2,511 hours, and all the lumen maintenance factors (at 1,500 hours and at 2,000 hours) and the lifetime are satisfied.

EXPERIMENTAL EXAMPLE 2

In Experimental Example 2, the amounts of enclosed metal halides within the closed glass bulb 5*a* are adjusted to be about $NaI:ScI_3:ScBr_3:InI:ZnI_2$=62:14:8.8:0.2:15 wt %. That is, the amount of enclosed $ScBr_3$ relative to the total amount of enclosed metal halides is about 8.8 wt %.

The luminous flux and the tube voltage at the initial stage of lighting are about 3,094 lumens and about 42.5 V, and thus satisfy the target values of 3,000 lumens and 42 V, respectively. In the life performance characteristics, the lumen maintenance factor at 1,500 hours is about 87.1%, the lumen maintenance factor at 2,000 hours is about 80.2%, the lifetime is about 2,711 hours, and all the lumen maintenance factors (at 1,500 hours and at 2,000 hours) and the lifetime are satisfied.

EXPERIMENTAL EXAMPLE 3

In Experimental Example 3, the amounts of enclosed metal halides within the closed glass bulb 5*a* are adjusted to be about $NaI:ScI_3:ScBr_3:InI:ZnI_2$=62:13.8:15:0.2:9 wt %. That is, the amount of enclosed $ScBr_3$ relative to the total amount of enclosed metal halides is about 15 wt %.

The luminous flux and the tube voltage at the initial stage of lighting are about 3,060 lumens and about 42.1 V, and thus satisfy the target values of 3,000 lumens and 42 V, respectively. In the life performance characteristics, the lumen maintenance factor at 1,500 hours is about 87.2%, the lumen maintenance factor at 2,000 hours is about 82.1%, the lifetime is about 2,675 hours, and all the lumen maintenance factors (at 1,500 hours and at 2,000 hours) and the lifetime are satisfied.

EXPERIMENTAL EXAMPLE 4

In Experimental Example 4, the amounts of enclosed metal halides within the closed glass bulb 5*a* are adjusted to be about $NaI:ScI_3:ScBr_3:InI:ZnI_2$=62:8.8:20:0.2:9 wt %. That is, the amount of enclosed $ScBr_3$ relative to the total amount of enclosed metal halides is about 20 wt %.

The luminous flux and the tube voltage at the initial stage of lighting are about 3,070 lumens and about 42.2 V, and thus satisfy the target values of 3,000 lumens and 42 V, respectively. In the life performance characteristics, the lumen maintenance factor at 1,500 hours is about 88.4%, the lumen maintenance factor at 2,000 hours is about 81.7%, the lifetime is about 2,788 hours, and all the lumen maintenance factors (at 1,500 hours and at 2,000 hours) and the lifetime can be satisfied.

EXPERIMENTAL EXAMPLE 5

In Experimental Example 5, the amounts of enclosed metal halides within the closed glass bulb 5*a* are adjusted to be about $NaI:ScI_3:ScBr_3:InI:ZnI_2$=62:5:23.8:0.2:9 wt %. That is, the amount of enclosed $ScBr_3$ relative to the total amount of enclosed metal halides is about 23.8 wt %.

The luminous flux and the tube voltage at the initial stage of lighting are about 3,011 lumens and about 41.3 V, and thus the luminous flux satisfies the target value of 3,000 lumens but the tube voltage is slightly lower than the target value of 42 V. In the life performance characteristics, the lumen maintenance factor at 1,500 hours is about 86.8%, the lumen maintenance factor at 2,000 hours is about 79.4%, the lifetime is about 2,666 hours, and all the lumen maintenance factors (at 1,500 hours and at 2,000 hours) and the lifetime are satisfied.

EXPERIMENTAL EXAMPLE 6

In Experimental Example 6, the amounts of enclosed metal halides within the closed glass bulb 5*a* are adjusted to be about $NaI:ScI_3:ScBr_3:InI:ZnI_2$=62:0:28.8:0.2:9 wt %. That is, the amount of enclosed $ScBr_3$ relative to the total amount of enclosed metal halides is about 28.8 wt %.

The luminous flux and the tube voltage at the initial stage of lighting are about 2,971 lumens and about 40.6 V, and are significantly lower than the respective target values of 3,000 lumens and 42 V. In the life performance characteristics, the lumen maintenance factor at 1,500 hours is about 84.5%, the lumen maintenance factor at 2,000 hours is about 78.5%, the lifetime is about 2,305 hours, and all the lumen maintenance factors (at 1,500 hours and at 2,000 hours) and the lifetime are not satisfied.

COMPARATIVE EXAMPLE

In Comparative Example (BM) in which $ScBr_3$ is not enclosed at all, the amounts of enclosed metal halides within the closed glass bulb 5*a* are adjusted to be about $NaI:ScI_3:ScBr_3:InI:ZnI_2$=62:28.8:0:0.2:9 wt %. That is, the amount of enclosed $ScBr_3$ relative to the total amount of enclosed metal halides is 0 wt %.

The luminous flux and the tube voltage at the initial stage of lighting are about 2,980 lumens and about 42 V, and thus the luminous flux is significantly lower than the target value of 3,000 lumens. In the life performance characteristics, the lumen maintenance factor at 1,500 hours is about 85.1%, the lumen maintenance factor at 2,000 hours is about 78.8%, the lifetime is about 2,320 hours, and all the lumen maintenance factors (at 1,500 hours and at 2,000 hours) and the lifetime are not satisfied.

While the present invention has been shown and described with reference to certain exemplary embodiments thereof, other implementations are within the scope of the claims. It will be understood by those skilled in the art that various changes in form and details may be made therein without departing from the spirit and scope of the invention as defined by the appended claims.

What is claimed is:

1. A mercury-free arc tube for a discharge lamp unit comprising:

a shroud glass tube;

a closed glass bulb, which is surrounded by the shroud glass tube; and a pair of electrodes, which are disposed to be opposed to each other in the closed glass bulb, wherein main light emitting substances of NaI, $ScI_3$, and $ScBr_3$ and buffer substances of InI and $ZnI_2$ are enclosed together with Xe gas in the closed glass bulb, and wherein an amount of enclosed $ScBr_3$ is in a range of about 5 wt % to about 24 wt % relative to a total weight of the substances enclosed in the closed glass bulb.

2. The mercury-free arc tube according to claim 1, wherein the amount of enclosed $ScBr_3$ is 20 wt % or less relative to the total weight of the substances enclosed in the closed glass bulb.

3. The mercury-free arc tube according to claim 1, further comprising:

pinch seal portions, which are formed on both end portions of the closed glass bulb;

Molybdenum foils, which are sealed at the pinch seal portions and which are connected to the electrodes; and lead wires, which are connected to the Molybdenum foils and which are led out from the end portions of the pinch seal portions, wherein each of the electrodes is formed in a rod shape and projected into the closed glass bulb, and wherein the electrodes, the Molybdenum foils and the lead wires are connected in series to each other respectively.

4. The mercury-free arc tube according to claim 3, wherein the electrodes, the Molybdenum foils and the lead wires are subjected to a vacuum heat treatment prior to assembly.

5. The mercury-free arc tube according to claim 2, further comprising:

pinch seal portions, which are formed on both end portions of the closed glass bulb;

Molybdenum foils, which are sealed at the pinch seal portions and which are connected to the electrodes; and lead wires, which are connected to the Molybdenum foils and which are led out from the end portions of the pinch seal portions, wherein each of the electrodes is formed in a rod shape and projected into the closed glass bulb, and wherein the electrodes, the Molybdenum foils and the lead wires are connected in series to each other respectively.

6. The mercury-free arc tube according to claim 5, wherein the electrodes, the Molybdenum foils and the lead wires are subjected to a vacuum heat treatment prior to assembly.

* * * * *